US010385297B2

(12) United States Patent
Song et al.

(10) Patent No.: US 10,385,297 B2
(45) Date of Patent: Aug. 20, 2019

(54) METHODS FOR MAKING ENCAPSULATE-CONTAINING PRODUCT COMPOSITIONS

(71) Applicant: The Procter & Gamble Company, Cincinnati, OH (US)

(72) Inventors: Xinbei Song, Cincinnati, OH (US); Douglas James Wildemuth, Cincinnati, OH (US); Corey James Kenneally, Mason, OH (US); Pierre Verstraete, Woluwe St Lambert (BE); Oliver Fasbender, Ixelles (BE)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 15/460,272

(22) Filed: Mar. 16, 2017

(65) Prior Publication Data

US 2018/0265826 A1 Sep. 20, 2018

(51) Int. Cl.

| | |
|---|---|
| ***C11D 11/00*** | (2006.01) |
| ***C11D 17/00*** | (2006.01) |
| ***C11D 3/37*** | (2006.01) |
| ***C11D 3/04*** | (2006.01) |
| ***C11D 3/16*** | (2006.01) |
| ***C11D 3/50*** | (2006.01) |
| ***C11D 7/06*** | (2006.01) |
| ***C11D 7/08*** | (2006.01) |
| ***C11D 7/22*** | (2006.01) |

(52) U.S. Cl.

CPC ..... *C11D 17/0039* (2013.01); *C11D 3/042* (2013.01); *C11D 3/044* (2013.01); *C11D 3/166* (2013.01); *C11D 3/3753* (2013.01); *C11D 3/3765* (2013.01); *C11D 3/505* (2013.01); *C11D 7/06* (2013.01); *C11D 7/08* (2013.01); *C11D 7/22* (2013.01); *C11D 17/0013* (2013.01)

(58) Field of Classification Search

None

See application file for complete search history.

(56) References Cited

U.S. PATENT DOCUMENTS

| | | | |
|---|---|---|---|
| 3,049,509 | A | 8/1962 | Hardy et al. |
| 5,281,355 | A | 1/1994 | Tsaur et al. |
| 6,355,263 | B1 | 3/2002 | Shuku et al. |
| 6,838,087 | B1 | 1/2005 | Day |
| 6,872,696 | B2 | 3/2005 | Becker et al. |
| 6,949,498 | B2 | 9/2005 | Murphy et al. |

(Continued)

FOREIGN PATENT DOCUMENTS

| | | | |
|---|---|---|---|
| EP | 0079712 | B2 | 10/1993 |
| WO | WO9322417 | A1 | 11/1993 |

(Continued)

OTHER PUBLICATIONS

U.S. Appl. No. 15/460,277, filed Mar. 16, 2017, Xinbei Song.

(Continued)

*Primary Examiner* — Lorna M Douyon

(74) *Attorney, Agent, or Firm* — Andres E. Valarde; Greg Darley-Emerson

(57) ABSTRACT

Methods relating to making product compositions that include encapsulates and borate compounds, where the encapsulates include polyvinyl alcohol polymer. Compositions made from such methods.

15 Claims, 4 Drawing Sheets

(56) References Cited

U.S. PATENT DOCUMENTS

| | | | | |
|---|---|---|---|---|
| 7,169,741 | B2 | 1/2007 | Barry et al. | |
| 7,968,510 | B2 | 6/2011 | Smets et al. | |
| 8,853,142 | B2 | 10/2014 | Corominas et al. | |
| RE45,538 | E | 6/2015 | Smets et al. | |
| 9,162,085 | B2 | 10/2015 | Dihora et al. | |
| 9,186,642 | B2 | 11/2015 | Dihora et al. | |
| 2002/0010123 | A1 | 1/2002 | Schmiedel et al. | |
| 2004/0092425 | A1 | 5/2004 | Boutique et al. | |
| 2007/0202063 | A1 | 8/2007 | Dihora et al. | |
| 2009/0226529 | A1 | 9/2009 | Quellet et al. | |
| 2010/0029537 | A1* | 2/2010 | Dihora | A01N 25/26 510/276 |
| 2011/0021408 | A1* | 1/2011 | Meek | C11D 3/226 510/321 |
| 2011/0110997 | A1* | 5/2011 | Cunningham | A61K 8/11 424/401 |
| 2011/0268802 | A1* | 11/2011 | Dihora | A61K 8/11 424/489 |
| 2011/0269658 | A1 | 11/2011 | Dihora et al. | |
| 2013/0039962 | A1 | 2/2013 | Smets et al. | |
| 2013/0302392 | A1 | 11/2013 | Mistry et al. | |
| 2017/0002302 | A1 | 1/2017 | Dihora et al. | |

FOREIGN PATENT DOCUMENTS

| | | | |
|---|---|---|---|
| WO | WO9948479 | A1 | 9/1999 |
| WO | WO0140430 | A1 | 6/2001 |
| WO | WO2011054389 | A1 | 5/2011 |
| WO | WO2011056934 | A1 | 5/2011 |
| WO | WO2011056935 | A1 | 5/2011 |
| WO | WO2012022034 | A1 | 2/2012 |
| WO | WO2012022736 | A1 | 2/2012 |
| WO | WO2012075293 | A2 | 6/2012 |
| WO | WO2013026657 | A1 | 2/2013 |

OTHER PUBLICATIONS

U.S. Appl. No. 15/460,279, filed Mar. 16, 2017, Xinbei Song.
U.S. Appl. No. 62/472,010, filed Mar. 16, 2017, Pierre Verstraete.
U.S. Appl. No. 62/472,012, filed Mar. 16, 2017, Hiroshi Oh.
Search Report for PCT/US2018/019815, dated May 18, 2018, 13 pages.
Search Report for PCT/US2018/019816, dated Jun. 7, 2018, 12 pages.
Search Report for PCT/US2018/019817, dated Jun. 6, 2018, 14 pages.

* cited by examiner

| Slurry No. | Slurry (20x) | Final detergent: Aged 1 week at room temperature (20x) | Final detergent: Aged 7.5 weeks at 40°C (20x) |
|---|---|---|---|
| 1 (comp.) |  | No aging - white flocculates/aggregates immediately form in final detergent product, as shown below:  | |
| 2 (diluted) |  |  |  |
| 3 (diluted) |  |  |  |
| 4 (diluted) |  |  |  |

METHODS FOR MAKING ENCAPSULATE-CONTAINING PRODUCT COMPOSITIONS

FIELD OF THE INVENTION

The present disclosure relates to methods of making product compositions that include encapsulates and borate compounds, where the encapsulates include polyvinyl alcohol polymer. The present disclosure further relates to compositions made from such methods.

BACKGROUND OF THE INVENTION

Consumer product compositions, such as detergent compositions, comprising borate derivatives are known. Borate derivatives (such as sodium tetraborate) may promote, for example, enzyme stability in the consumer product compositions.

Consumer product compositions that include benefit agent encapsulates are also known. For example, such encapsulates may be core-shell encapsulates and have perfume in the core. Certain encapsulates may include polyvinyl alcohol, for example as part of the shell. The encapsulates may be provided to a product manufacturer as a concentrated composition, such as an encapsulate slurry.

However, it can be challenging to manufacture a liquid consumer product composition that has both a borate derivative and encapsulates when the encapsulates include polyvinyl alcohol. Aggregation of the encapsulates may occur, resulting in poor product stability, poor performance, and/or unacceptable product aesthetics. Without wishing to be bound by theory, it is believed that the aggregation is a result from cross-linking due to hydrogen bonding that can occur between hydroxyl groups (—OH) of the borate derivatives and hydroxyl groups of the polyvinyl alcohol.

There is a need, then, for improved processes for manufacturing consumer product compositions that include borate derivatives and encapsulates, where the encapsulates include polyvinyl alcohol.

SUMMARY OF THE INVENTION

The present disclosure relates to methods of making product compositions that include encapsulates and borate compounds, where the encapsulates include polyvinyl alcohol polymer.

The present disclosure relates a method of making a detergent composition, where the method includes the steps of: providing a first composition that includes encapsulates, where the first composition includes no more than about 15 wt % of the encapsulates, and where the encapsulates include polyvinyl alcohol polymer; and combining the first composition with a second composition that includes a borate compound, thereby forming a product composition.

The present disclosure further relates to product compositions made from the methods described herein.

BRIEF DESCRIPTION OF THE DRAWINGS

The figures herein are illustrative in nature and are not intended to be limiting.

DETAILED DESCRIPTION OF THE INVENTION

The present disclosure relates to improved processes for manufacturing product compositions, such as liquid detergent compositions, that include borate compounds and encapsulates that include polyvinyl alcohol.

As mentioned above, polyvinyl alcohol (i) and borate compounds (ii) can react according to the basic reaction shown below, creating a cross-linked species (iii).

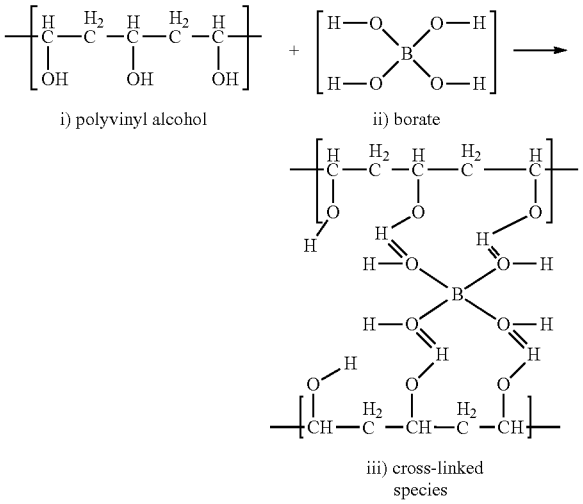

When encapsulates that include polyvinyl alcohol are combined with borate compounds, the cross-linking reaction can result in the aggregation of encapsulates, creating undesirable flocculation in the product.

In view of this problem, it has been surprisingly found that particular order-of-addition steps in the making of finished product can be important to prevent or mitigate this aggregation issue. For example, it has been found that providing a sufficiently-diluted composition that includes encapsulates comprising polyvinyl alcohol polymer before combining it with borate compounds results in product compositions that do not show significant aggregation of the encapsulates.

Figure 1:
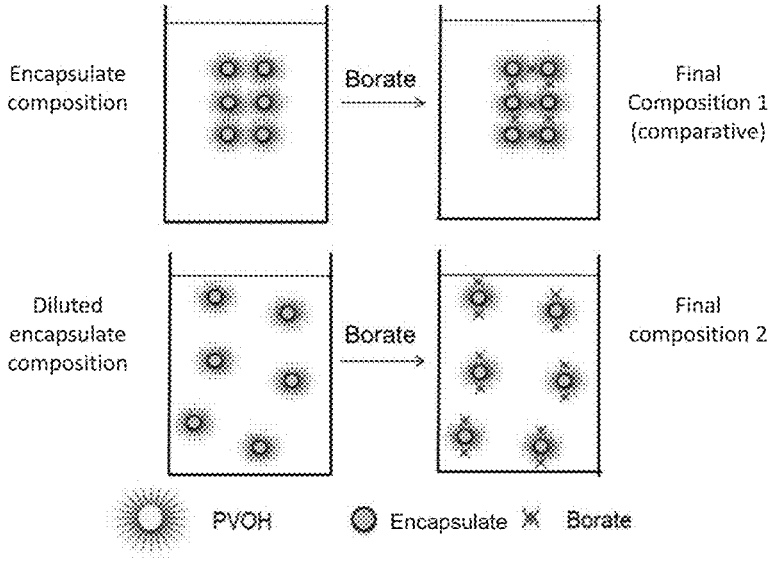
FIG. 1 shows schematic drawings of the interactions between encapsulates and borate.

Without wishing to be bound by theory, it is believed that polyvinyl alcohol (PVOH) polymers are embedded in the wall of the certain encapsulates. As schematically shown in FIG. 1, when the encapsulates are at a relatively high concentration, they are relatively close together; when combined with borate, the borate cross-links with the PVOH to form aggregates in the product (Final Composition 1). However, when the encapsulates are separated to a certain "safe" distance by dilution, borate cannot cross-link with PVOH on two or more encapsulates to generate the encapsulate aggregation in the product (Final Composition 2). The presently disclosed process includes certain order-of-addition (OOA) steps for making finished products where the encapsulates are introduced in the earlier steps, thereby separating the encapsulates to the "safe" distance. The spaced-apart encapsulates are then combined with borate, and the aggregation is prevented or at least minimized Providing such a first composition that includes encapsulates may occur in a variety of ways. For example, encapsulates, for example as part of a slurry, may be added to a base detergent composition prior to borate compounds being added. As another example, an encapsulate-containing slurry may be diluted with a diluent before being combined with a borate-containing composition; the diluent may be a component that is desirable or necessary in the final product. Such dilution of the slurry may occur prior to the manufacturing process, or it may occur as an in-line process when making the liquid detergent finished products, for example as the encapsulates are being added to the base composition.

The methods and compositions of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein "consumer product" means baby care, beauty care, fabric & home care, family care, feminine care, health care, snack and/or beverage products or devices intended to be used or consumed in the form in which it is sold, and not intended for subsequent commercial manufacture or modification. Such products include but are not limited to fine fragrances (e.g. perfumes, colognes eau de toilettes, after-shave lotions, pre-shave, face waters, tonics, and other fragrance-containing compositions for application directly to the skin), diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric conditioning (including softening), laundry detergency, laundry and rinse additive and/or care, hard surface cleaning and/or treatment, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, RX pharmaceuticals, pet health and nutrition, and water purification; processed food products intended primarily for consumption between customary meals or as a meal accompaniment (non-limiting examples include potato chips, tortilla chips, popcorn, pretzels, corn chips, cereal bars, vegetable chips or crisps, snack mixes, party mixes, multigrain chips, snack crackers, cheese snacks, pork rinds, corn snacks, pellet snacks, extruded snacks and bagel chips); and coffee.

As used herein, the term "cleaning composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various pouches, tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, the term "fabric care composition" includes, unless otherwise indicated, fabric softening compositions, fabric enhancing compositions, fabric freshening compositions and combinations thereof. The form of such compositions includes liquids, gels, beads, powders, flakes, and granules. Suitable forms also include unit dose articles that include such compositions, such as single- and multi-compartmented unit dose articles.

Unless otherwise noted, all component or composition levels are in reference to the active portion of that component or composition, and are exclusive of impurities, for example, residual solvents or by-products, which may be present in commercially available sources of such components or compositions.

For purposes of this application, castor oil, soybean oil, brominated vegetable oil, propan-2-yl tetradecanoate and mixtures thereof are not considered a perfume raw material when calculating perfume compositions/formulations. Thus, the amount of propan-2-yl tetradecanoate present is not used to make such calculations.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

First Composition Comprising Encapsulates

The methods and compositions of the present disclosure relate to a first composition comprising encapsulates. The first composition may be substantially free (e.g., contains less 0%) of borate compounds.

Figure 2:
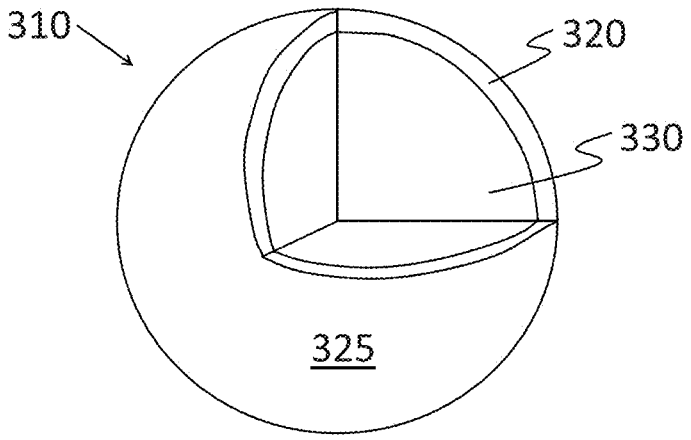
FIG. 2 shows an encapsulate of the present disclosure.
Figure 3:
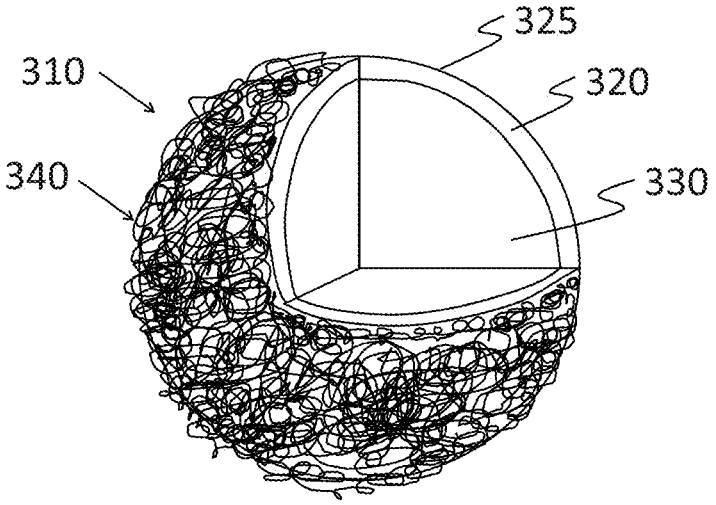
FIG. 3 shows an encapsulate of the present disclosure.

The present disclosure relates to encapsulates. As schematically shown in FIG. 2, an encapsulate 310 may include a core 330 and a wall 320 at least partially surrounding the core 330. (As used herein, the terms "wall" and "shell" are used interchangeable with respect to encapsulates.) The core 330 may include a benefit agent, such as perfume. The wall 320 may include an outer surface 325. As schematically shown in FIG. 3, the outer surface 325 of the wall 320 may include a coating 340. The coating 340 may include an efficiency polymer. These elements are discussed in more detail below.

The encapsulates may have a volume weighted mean encapsulate size of from about 0.5 microns to about 100 microns, or from about 1 microns to about 60 microns. Determination of the volume weighted mean encapsulate size is determined according to the method provided in the Test Methods section below.

The first composition may comprise no more than 15% of encapsulates. The first composition may comprise from about 0.1%, or from about 0.5%, or from about 1%, or from about 2%, or from about 5%, to about 15%, or to about 12%, or to about 10%, by weight of the first composition, of encapsulates.

The encapsulates may include a polyvinyl alcohol polymer. The polyvinyl alcohol polymer may be found in any location or region of the encapsulate that may interact with borate compounds. For example, the polyvinyl alcohol polymer may be found in a core, a wall, an outer surface, and/or a coating of the encapsulates. The polyvinyl alcohol may be intentionally added to the encapsulates as an encapsulate component, such as a coating. The polyvinyl alcohol may be present in the encapsulates as an impurity that remains from the encapsulate-making process; for example, the polyvinyl alcohol may have been used to emulsify or suspend the main shell material as the encapsulates were manufactured.

The polyvinyl alcohol may be present in the encapsulates at a level of from about 0.1%, or from about 0.5%, to about 40%, or from about 0.8% to about 5%, by weight of the encapsulates. The polyvinyl alcohol polymer may be characterized by one or more of the following characteristics, as described below: hydrolysis degree, viscosity, degree of polymerization, weight average molecular weight, and/or number average molecular weight.

Suitable polyvinyl alcohol polymers may have a hydrolysis degree from about 55% to about 99%, or from about 75% to about 95%, or from about 85% to about 90%, or from about 87% to about 89%. Suitable polyvinyl alcohol polymers may have a viscosity of from about 40 cps to about 80 cps, or from about 45 cps to about 72 cps, or from about 45 cps to about 60 cps, or from about 45 cps to about 55 cps in 4% water solution at 20° C. Suitable polyvinyl alcohol polymers may be characterized by a degree of polymerization of from about 1500 to about 2500, or from about 1600 to about 2200, or from about 1600 to about 1900, or from about 1600 to about 1800. Suitable polyvinyl alcohol polymers may be characterized by a weight average molecular weight of from about 130,000 to about 204,000 Daltons, or from about 146,000 to about 186,000, or from about 146,000 to about 160,000, or from about 146,000 to about 155,000. Suitable polyvinyl alcohol polymers may be characterized by a number average molecular weight of from about 65,000 to about 110,000, or from about 70,000 to about 101,000, or from about 70,000 to about 90,000, or from about 70,000 to about 80,000 Daltons. The polyvinyl alcohol polymers found in the encapsulates of the present disclosure may have any suitable combination of these characteristics.

The encapsulate may comprise from 0.1% to 1.1%, by weight of the encapsulates, of polyvinyl alcohol. The polyvinyl alcohol may have at least one the following properties, or a mixture thereof: (i) a hydrolysis degree from 55% to 99%; (ii) a viscosity of from 40 mPa·s to 120 mPa·s in 4% water solution at 20° C.; (iii) a degree of polymerization of from 1,500 to 2,500; (iv) number average molecular weight of from 65,000 Da to 110,000 Da.

The encapsulates may include a core and a shell that at least partially surrounds the core. The core may include a benefit agent. Suitable benefit agent may be benefit agents that provide benefits to a surface, such as a fabric. The benefit agent may be selected from the group consisting of perfume raw materials, silicone oils, waxes, hydrocarbons, higher fatty acids, essential oils, lipids, skin coolants, vitamins, sunscreens, antioxidants, glycerine, catalysts, bleach encapsulates, silicon dioxide encapsulates, malodor reducing agents, odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. The benefit agent may include perfume raw materials.

The core may also comprise a partitioning modifier. Suitable partitioning modifiers may include vegetable oil, modified vegetable oil, propan-2-yl tetradecanoate and mixtures thereof. The modified vegetable oil may be esterified and/or brominated. The vegetable oil comprises castor oil and/or soy bean oil. The partitioning modifier may be propan-2-yl tetradecanoate. The partitioning modifier may be present in the core at a level, based on total core weight, of greater than 20%, or from greater than 20% to about 80%, or from greater than 20% to about 70%, or from greater than 20% to about 60%, or from about 30% to about 60%, or from about 30% to about 50%.

The shell of the encapsulates may include a shell material. The shell material may include a material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof.

The shell material may include a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof. The shell material may include a polyacrylate polymer. The wall may include from about 50% to about 100%, or from about 70% to about 100%, or from about 80% to about 100% of a polyacrylate polymer. The polyacrylate may include a polyacrylate cross linked polymer.

The wall material of the encapsulates may include a polymer derived from a material that comprises one or more multifunctional acrylate moieties. The multifunctional acrylate moiety may be selected from the group consisting of tri-functional acrylate, tetra-functional acrylate, penta-functional acrylate, hexa-functional acrylate, hepta-functional acrylate and mixtures thereof. The wall material may include a polyacrylate that comprises a moiety selected from the group consisting of an amine acrylate moiety, methacrylate moiety, a carboxylic acid acrylate moiety, carboxylic acid methacrylate moiety, and combinations thereof.

The wall material may include a material that comprises one or more multifunctional acrylate and/or methacrylate moieties. The ratio of material that comprises one or more multifunctional acrylate moieties to material that comprises one or more methacrylate moieties may be from about 999:1 to about 6:4, or from about 99:1 to about 8:1, or from about 99:1 to about 8.5:1. The multifunctional acrylate moiety may be selected from the group consisting of tri-functional acrylate, tetra-functional acrylate, penta-functional acrylate, hexa-functional acrylate, hepta-functional acrylate and mixtures thereof. The wall material may include a polyacrylate that comprises a moiety selected from the group consisting of an amine acrylate moiety, methacrylate moiety, a carboxylic acid acrylate moiety, carboxylic acid methacrylate moiety and combinations thereof.

The wall material may include an aminoplast. The aminoplast may include a polyurea, polyurethane, and/or polyureaurethane. The aminoplast may include an aminoplast copolymer, such as melamine-formaldehyde, urea-formaldehyde, cross-linked melamine formaldehyde, or mixtures thereof. The wall may include melamine formaldehyde, which may further include a coating as described below. The encapsulate may include a core that comprises perfume, and a wall that includes melamine formaldehyde and/or cross linked melamine formaldehyde. The encapsulate may include a core that comprises perfume, and a wall that comprises melamine formaldehyde and/or cross linked melamine formaldehyde, poly(acrylic acid) and poly(acrylic acid-co-butyl acrylate).

A deposition aid may at least partially coat the encapsulates, for example an outer surface of the wall of the encapsulates. The deposition aid may include a material selected from the group consisting of poly(meth)acrylate, poly(ethylene-maleic anhydride), polyamine, wax, polyvinylpyrrolidone, polyvinylpyrrolidone co-polymers, polyvinylpyrrolidone-ethyl acrylate, polyvinylpyrrolidone-vinyl acrylate, polyvinylpyrrolidone methylacrylate, polyvinylpyrrolidone/vinyl acetate, polyvinyl acetal, polyvinyl butyral, polysiloxane, poly(propylene maleic anhydride), maleic anhydride derivatives, co-polymers of maleic anhydride derivatives, polyvinyl alcohol, styrene-butadiene latex, gelatin, gum Arabic, carboxymethyl cellulose, carboxymethyl hydroxyethyl cellulose, hydroxyethyl cellulose, other modified celluloses, sodium alginate, chitosan, casein, pectin, modified starch, polyvinyl acetal, polyvinyl butyral, polyvinyl methyl ether/maleic anhydride, polyvinyl pyrrolidone and its copolymers, poly(vinyl pyrrolidone/methacrylamidopropyl trimethyl ammonium chloride), polyvinylpyrrolidone/vinyl acetate, polyvinyl pyrrolidone/dimethylaminoethyl methacrylate, polyvinyl amines, polyvinyl formamides, polyallyl amines and copolymers of polyvinyl amines, polyvinyl formamides, polyallyl amines and mixtures thereof. The coating may include the polyvinyl alcohol described above.

The core/shell encapsulate may comprise an emulsifier, wherein the emulsifier is preferably selected from anionic emulsifiers, nonionic emulsifiers, cationic emulsifiers or mixtures thereof, preferably nonionic emulsifiers.

The first composition may be a base product composition, such as a (liquid) base detergent. The base detergent may comprise product adjuncts, including from about 5% to about 60% surfactant by weight of the composition, as described below.

For ease of manufacturing and/or transport, encapsulates may be provided as a slurry composition having a relatively high concentration of encapsulates. However, it has been found that when such a slurry composition is combined with borate compounds, undesirable aggregation of the encapsulates may occur, as described above. Therefore, the first composition may be obtained by diluting an encapsulate slurry composition.

In other words, the method described herein may include the step of providing a slurry composition that contains the encapsulates described herein. The slurry may include from about 20% to about 60%, by weight of the slurry composition, of the encapsulates. The slurry may include water, organic solvent, surfactant, antimicrobials, external structurant, or any other suitable materials. The slurry may include a limited number of ingredients, such as no more than seven, or no more than six, or no more than five ingredients.

The method may further comprise the step of diluting the slurry composition with a diluent to form the first composition. The diluent may include any material suitable for inclusion in the final product composition. For example, the diluent may include water, organic solvent, surfactant, an external structurant, or combinations thereof. The diluent may include other product adjuncts, as described below.

The diluting step may occur at any suitable time, so long as it is prior to the combination of the first composition with the second (borate-containing) composition. For example, a slurry composition may be diluted by the slurry manufacturer. A slurry may be diluted by the final product manufacturer in advance of making the product composition. The slurry may be diluted as an in-line step of the product manufacturing process. For example, the slurry may be combined with the diluent to form the first composition, and then first composition may then almost immediately be combined with the second composition.

The slurry and/or first composition may have a pH of from about 1 to about 7, or from about 2 to about 6, or from about 3 to about 6, or from about 4 to about 6. The pH is measured as a 10% dilution in deionized water (1 part composition, 9 parts water). It is believed that maintaining a lower pH in the slurry or first composition results in less encapsulate aggregation in the final product.

Second Composition Comprising a Borate Compound

The methods described herein further comprise the step of providing a second composition, where the second composition comprises a borate compound. The first composition and the second composition may be combined, which may form a product composition.

The borate compound may be any compound that is suitable for inclusion in a desired product composition. Borate compounds may be capable of providing different benefits, such as benefits related to pH buffering and/or enzyme stabilization.

As used in the present disclosure, a "borate compound" is a compound that comprises borate or that is capable of providing borate in solution. As used herein, borate compounds include boric acid, boric acid derivatives, boronic acid, boronic acid derivatives, and combinations thereof.

Boric acid has the chemical formula $H_3BO_3$ (sometimes written as $B(OH)_3$). Boric acid derivatives include boron-containing compounds where at least a portion of the compound is present in solution as boric acid or a chemical equivalent thereof. Suitable boric acid derivatives include MEA-borate (i.e., monoethanolamine borate), borax, boric oxide, tetraborate decahydrate, tetraborate pentahydrate, alkali metal borates (such as sodium ortho-, meta- and pyroborate and sodium pentaborate), and mixtures thereof.

Boronic acid has the chemical formula $R—B(OH)_2$, where R is a non-hydroxyl substituent group. R may be selected from the group consisting of substituted or unsubstituted C6-C10 aryl groups and substituted or unsubstituted C1-C10 alkyl groups. R may be selected from the group consisting of substituted or unsubstituted C6 aryl groups and substituted or unsubstituted C1-C4 alkyl groups. The boronic acid may be selected from the group consisting of phenylboronic acid, ethylboronic acid, 3-nitrobenzeneboronic acid, and mixtures thereof.

The boronic acid may be a compound according to Formula I:

(I)

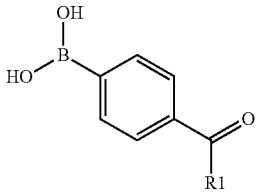

wherein R1 is selected from the group consisting of hydrogen, hydroxy, C1-C6 alkyl, substituted C1-C6 alkyl, C2-C6 alkenyl and substituted C2-C6 alkenyl. R1 may be a C1-C6 alkyl, in particular wherein $R^1$ is $CH_3$, $CH_3CH_2$ or $CH_3CH_2CH_2$, or wherein $R^1$ is hydrogen. The boronic acid may include 4-formyl-phenyl-boronic acid (4-FPBA).

The boronic acid may be selected from the group consisting of: thiophene-2 boronic acid, thiophene-3 boronic acid, acetamidophenyl boronic acid, benzofuran-2 boronic acid, naphtalene-1 boronic acid, naphtalene-2 boronic acid, 2-FPBA, 3-FBPA, 4-FPBA, 1-thianthrene boronic acid, 4-dibenzofuran boronic acid, 5-methylthiophene-2 boronic, acid, thionaphtrene boronic acid, furan-2 boronic acid, furan-3 boronic acid, 4,4 biphenyl-diborinic acid, 6-hydroxy-2-naphtalene, 4-(methylthio) phenyl boronic acid, 4 (trimethyl-silyl)phenyl boronic acid, 3-bromothiophene boronic acid, 4-methylthiophene boronic acid, 2-naphtyl boronic acid, 5-bromothiphene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, di-benzothiophene boronic acid, 4-carboxyphenyl boronic acid, 9-anthryl boronic acid, 3,5 dichlorophenyl boronic, acid, diphenyl boronic acidanhydride, o-chlorophenyl boronic acid, p-chlorophenyl boronic acid,m-bromophenyl boronic acid, p-bromophenyl boronic acid, p-flourophenyl boronic acid, p-tolyl boronic acid, o-tolyl boronic acid, octyl boronic acid, 1,3,5 trimethylphenyl boronic acid, 3-chloro-4-flourophenyl boronic acid, 3-aminophenyl boronic acid, 3,5-bis-(triflouromethyl)phenyl boronic acid, 2,4 dichlorophenyl boronic acid, 4-methoxyphenyl boronic acid, and combinations thereof.

The second composition may comprise from about 0.01% to about 10%, or from about 0.1% to about 5%, or from about 1% to about 3%, by weight of the second composition, of a borate compound.

The second composition may be a base product composition, such as a base detergent. The base detergent may comprise product adjuncts, as described below. The base detergent may comprise from about 5% to about 60%, by weight of the base detergent, of surfactant.

Product Composition

The methods described herein are useful for making a product composition. The product composition may be a consumer product composition. The product composition may be a cleaning composition. The product composition may be a fabric care composition.

Figure 4:
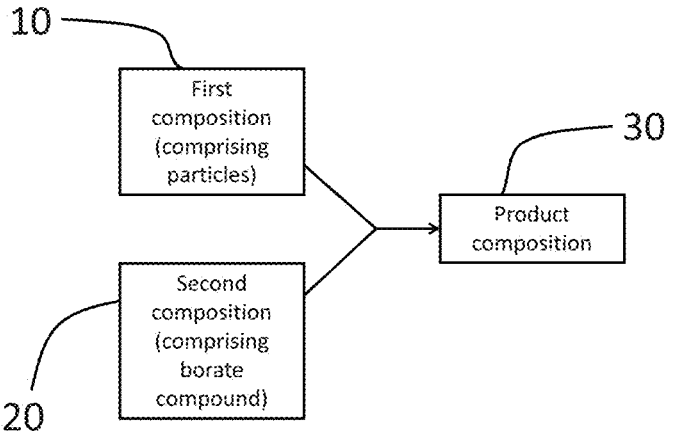
FIG. 4 shows a flowchart illustrating the steps of a method according to the present disclosure.
Figure 5:
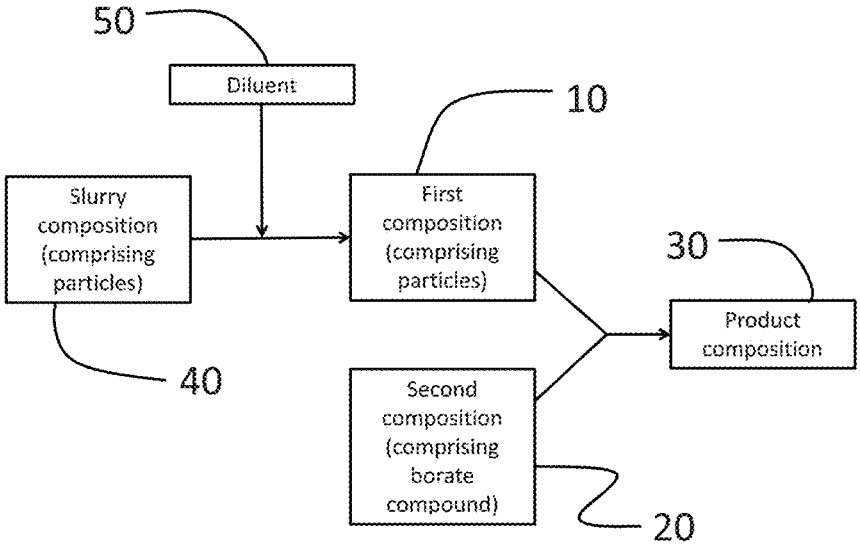
FIG. 5 shows a flowchart illustrating the steps of a method according to the present disclosure.

As described above and shown in FIG. 4, the first composition 10 and the second composition 20 may be combined to form a product composition 30. As shown in FIG. 5, a slurry composition 40, which may include encapsulates, may be diluted with a diluent 50 to form a first composition 10, which may then be combined with a second composition 20 to form a product composition 30.

The first and second compositions may be combined by any suitable method known to one of ordinary skill in the art. For example, the first and second compositions may be mixed with an in-line static mixer. The first and second composition may be mixed in a batch process, such as in a stirred tank.

The first and second compositions should be mixed at proportions suitable to give the desired levels of encapsulates and borate compound, respectively, in the product composition. The product composition may comprise from about 0.1% to about 5%, by weight of the product composition, of encapsulates. When the encapsulates include perfume raw materials, the product may comprise from about 0.1% to about 3%, or to about 2%, or to about 1%, or to about 0.75%, or to about 0.5%, by weight of the product composition, of perfume raw materials that are delivered by the encapsulates. The product composition may comprise from about 0.1% to about 4%, by weight of the product composition, of borate compound.

As described above, it is desired to minimize the aggregation of the encapsulates in the presence of borate compounds. The amount of aggregation may be determined using the Sieve Test method described below. The product composition may be characterized as having no more than 5 particles per gram of product composition, or no more than 4 particles per gram of product composition, or no more than 3 particles per gram of product composition, or no more than 2.5 particles per gram of product composition, as determined by the Sieve Test described herein.

The product composition may be in liquid form. The product composition may be a liquid detergent, including a heavy duty liquid (HDL) detergent suitable for treating fabrics. The product composition may be a compact liquid detergent, such as a 2×, 3×, or even 4× formulation.

The product composition may be in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the composition is contained in at least one of the compartments. The compartments may be arranged in superposed orientation, i.e., one positioned on top of the other, where they may share a common wall. At least one compartment may be superposed on another compartment. Alternatively, the compartments may be positioned in a side-by-side orientation, i.e., one orientated next to the other. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

The unit dose form may comprise water-soluble film that forms the compartment and encapsulates the detergent composition. Preferred film materials are polymeric materials; for example, the water-soluble film may comprise polyvinyl alcohol. The film material can, for example, be obtained by casting, blow-moulding, extrusion, or blown extrusion of the polymeric material, as known in the art. Suitable films are those supplied by Monosol (Merrillville, Ind., USA) under the trade references M8630, M8900, M8779, and M8310, films described in U.S. Pat. Nos. 6,166,117, 6,787,512, and US2011/0188784, and PVA films of corresponding solubility and deformability characteristics. In some cases, because the borate may interact with PVOH-based films, the polymeric materials of the film do not include polyvinyl alcohol and may instead comprise another suitable film-forming polymer.

When the product composition is a liquid, the fabric care composition typically comprises water. The composition may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

The first, second, and/or product compositions may include a surfactant system. The compositions may include from about 5% to about 60%, by weight of the composition, of the surfactant system. The composition may include from about 20%, or from about 25%, or from about 30%, or from about 35%, or from about 40%, to about 60%, or to about 55%, or to about 50%, or to about 45%, by weight of the composition, of the surfactant system. The composition may include from about 35% to about 50%, or from about 40% to about 45%, by weight of the composition, of a surfactant system. The product composition may comprise from about 5 wt % to about 60 wt % of a surfactant system. The first composition and/or the second composition may be a base detergent comprising from about 5 wt % to about 60 wt % of surfactant system.

The surfactant system may include any surfactant suitable for the intended purpose of the detergent composition. The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material.

The surfactant system may include anionic surfactant. The anionic surfactant may include alkoxylated sulfate surfactant, which may include alkyl ethoxylated sulfate. The anionic surfactant may include anionic sulphonate surfactant, which may include alkyl benzene sulphonate, including linear alkyl benzene sulphonate.

The surfactant system may include nonionic surfactant. These can include, for example, alkoxylated fatty alcohols and amine oxide surfactants. In some examples, the surfactant system may contain an ethoxylated nonionic surfactant.

The first, second, and/or product compositions may include any other suitable product adjuncts. Such adjuncts may be selected, for example, to provide performance benefits, stability benefits, and/or aesthetic benefits. Suitable product adjuncts may include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, antimicrobial agents and/or preservatives, neutralizers and/or pH adjusting agents, processing aids, opacifiers, pearlescent agents, pigments, or mixtures thereof. A few of these product adjuncts are discussed in more detail below.

The compositions may include an external structuring system. The structuring system may be used to provide sufficient viscosity to the composition in order to provide, for example, suitable pour viscosity, phase stability, and/or suspension capabilities.

The compositions of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

The compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the composition. Suitable crystallizable glycerides include hydrogenated castor oil or "HCO" or derivatives thereof, provided that it is capable of crystallizing in the liquid compositions described herein.

The compositions may comprise from about 0.01% to 5% by weight of a naturally derived and/or synthetic polymeric structurant. Suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable synthetic polymeric structurants include: polycarboxylates, polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

The compositions may include enzymes. Enzymes may be included in the compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the compositions described herein include hemicellulases, gluco-amylases, xylanases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

The present disclosure further relates to product compositions made according to the methods described herein. For example, the present disclosure relates to product compositions made according to the following steps: providing a first composition comprising encapsulates, where the first composition comprises no more than about 15 wt % of the encapsulates, and where the encapsulates comprise polyvinyl alcohol polymer; and combining the first composition with a second composition comprising a borate compound, thereby forming a product composition. The first composition may be made by providing a slurry that comprises from about 20 wt % to about 60 wt % of the encapsulates, by weight of the slurry, and diluting the slurry with a diluent to form the first composition. The product composition may include from about 5 wt % to about 60 wt % of surfactant. The product composition may be characterized as having no more than 5 particles per gram of product composition, or no more than 4 particles per gram of product composition, or no more than 3 particles per gram of product composition, or no more than 2.5 particles per gram of product composition, as determined by the Sieve Test method described herein.

Methods of Use

The present disclosure relates to a method of pretreating or treating a surface, such as a fabric, where the method includes the step of contacting the surface (e.g., fabric) with the product composition described herein. The contacting step may occur in the presence of water, where the water and the product composition form a wash liquor. The contacting may occur during a washing step, and water may be added before, during, or after the contacting step to form the wash liquor.

The washing step may be followed by a rinsing step. During the rinsing step, the fabric may be contacted with a fabric softening composition, wherein said fabric softening composition comprises a fabric softening active. The fabric softening active of the methods described herein may comprise a quaternary ammonium compound, silicone, fatty acids or esters, sugars, fatty alcohols, alkoxylated fatty alcohols, polyglycerol esters, oily sugar derivatives, wax emulsions, fatty acid glycerides, or mixtures thereof. Suitable commercially available fabric softeners may also be used, such those sold under the brand names DOWNY®, LENOR® (both available from The Procter & Gamble Company), and SNUGGLE® (available from The Sun Products Corporation). The step of contacting the fabric with a fabric softening composition may occur in the presence of water, for example during a rinse cycle of an automatic washing machine.

Any suitable washing machine may be used, for example, a top-loading or front-loading automatic washing machine. Those skilled in the art will recognize suitable machines for the relevant wash operation. The compositions of the present disclosure may be used in combination with other compositions, such as fabric additives, fabric softeners, rinse aids, and the like.

Additionally, the product compositions of the present disclosure may be used in known methods where a surface is treated/washed by hand.

COMBINATIONS

Specifically contemplated combinations of the disclosure are herein described in the following lettered paragraphs. These combinations are intended to be illustrative in nature and are not intended to be limiting.

A. A method of making a detergent composition, comprising the steps of: providing a first composition comprising encapsulates, wherein the first composition comprises no more than about 15 wt % of the encapsulates, and wherein the encapsulates comprise polyvinyl alcohol polymer; combining the first composition with a second composition comprising a borate compound, thereby forming a product composition.

B. A method according to paragraph A, wherein the encapsulates are microcapsules that comprise a core and a shell at least partially surrounding the core, wherein the core comprises a benefit agent, and wherein the shell comprises at least a portion of the polyvinyl alcohol polymer.

C. A method according to any of paragraphs A-B, wherein the benefit agent of the core comprises perfume raw materials.

D. A method according to any of paragraphs A-C, wherein the core further comprises a partitioning modifier.

E. A method according to any of paragraphs A-D, wherein the shell comprises a shell material selected from the group consisting of polyethylenes; polyamides; polystyrenes; polyisoprenes; polycarbonates; polyesters; polyacrylates; acrylics; aminoplasts; polyolefins; polysaccharides; gelatin; shellac; epoxy resins; vinyl polymers; water insoluble inorganics; silicone; and mixtures thereof.

F. A method according to any of paragraphs A-E, wherein the shell comprises a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

G. A method according to any of paragraphs A-F, wherein the shell material comprises a polyacrylate.

H. A method according to any of paragraphs A-G, wherein the encapsulates have a volume weighted mean encapsulate size of from about 0.5 microns to about 100 microns.

I. A method according to any of paragraphs A-H, wherein the borate compound is selected from the group consisting of boric acid, boric acid derivatives, and combinations thereof.

J. A method according to any of paragraphs A-I, wherein the borate compound is present in the product composition at a level of about 0.1 wt % to about 4 wt %.

K. A method according to any of paragraphs A-J, further comprising the steps of providing a slurry comprising from about 20 wt % to about 60 wt % of the encapsulates and diluting the slurry with a diluent to form the first composition.

L. A method according to any of paragraphs A-K, wherein the diluent comprises water, organic solvent, surfactant, an external structurant, or combinations thereof.

M. A method according to any of paragraphs A-L, wherein the slurry comprises an external structurant.

N. A method according to any of paragraphs A-M, wherein the product composition comprises from about 0.1 wt % to about 5 wt % of the encapsulates.

O. A method according to any of paragraphs A-N, wherein the product composition further comprises an enzyme.

P. A method according to any of paragraphs A-O, wherein the product composition further comprises an external structurant.

Q. A method according to any of paragraphs A-P, wherein the product composition comprises no more than 5 particles per gram of product composition, as determined by the Sieve Test method described herein.

R. A method according to any of paragraphs A-Q, wherein the product composition comprises from about 5 wt % to about 60 wt % of a surfactant system.

S. A method according to any of paragraphs A-R, wherein either the first composition or the second composition is a base detergent comprising from about 5 wt % to about 60 wt % of a surfactant system.

T. A product composition made according to the method of any of paragraphs A-S.

U. A product composition according to paragraph T, wherein the product composition comprises from about 5 wt % to about 60 wt % of surfactant.

TEST METHODS

Method for Determining Volume Weighted Mean Encapsulate Size

Encapsulate size is measured using an Accusizer 780A, made by Particle Sizing Systems, Santa Barbara Calif. The instrument is calibrated from 0 to 300 μm using Duke particle size standards. Samples for encapsulate size evaluation are prepared by diluting about 1 g emulsion, if the volume weighted mean encapsulate size of the emulsion is to be determined, or 1 g of capsule slurry, if the finished capsule volume weighted mean encapsulate size is to be determined, in about 5 g of de-ionized water and further diluting about 1 g of this solution in about 25 g of water.

About 1 g of the most dilute sample is added to the Accusizer and the testing initiated, using the autodilution feature. The Accusizer should be reading in excess of 9200 counts/second. If the counts are less than 9200 additional sample should be added. The accusizer will dilute the test sample until 9200 counts/second and initiate the evaluation. After 2 minutes of testing the Accusizer will display the results, including volume-weighted median size.

The broadness index can be calculated by determining the encapsulate size at which 95% of the cumulative encapsulate volume is exceeded (95% size), the encapsulate size at which 5% of the cumulative encapsulate volume is exceeded (5% size), and the median volume-weighted encapsulate size (50% size—50% of the encapsulate volume both above and below this size). Broadness Index (5)=((95% size)−(5% size)/50% size).

Sieve Test (Method for Determining Number of Particles)

The following method is used to determine the amount of particles of a certain minimum size per gram of a composition sample. The particles counted may be aggregates or any other particles found in the composition. In sum, a sample is weighed and dispensed onto a 212 micron sieve; the particles remaining on the sieve are counted. If the average number of particles remaining on the sieve for a composition is less than 2.5 particles/gram of composition, the composition is rated as a "pass", indicating that the composition has relatively few large particles per gram.

Sample Preparation:

When working with an encapsulate slurry composition, the slurry is filtered prior to using the method below. To filter the slurry, homogenize the slurry sample by gentle shaking or mixing. The homogenized sample is then filtered through a 425 micron sieve (available from VWR; catalog #57334-274) prior to use with the method.

Cleaning the Sieve(s):

Clean/rinse the sieve(s) thoroughly with tap water by adding a hose to the tap and squeezing the hose at the end to generate a strong jet. The sieve is first cleaned in an upside-down position, so that any aggregates that remain do not get pushed through the mesh. After the first portion of washing when the sieve is in an upside-down position, the sieve is flipped several times during the cleaning/rinsing process. Dry the sieve first with a towel or with paper, and then dry the mesh with pressurized air.

Test Method:

1. Clean and dry a 212 micron sieve (available from VWF; catalog #57334-282) according to the above instructions. Record the weight of the sieve.

2. Using a syringe, place a sample weighing about 20 g of the encapsulate-containing composition onto the sieve; the composition is spread in a line over the sieve. Record the weight of the sieve+composition and determine the amount of composition sample added by subtracting the weight of the sieve.

3. Tap the sieve lightly to allow the composition to flow through the sieve. Light air or nitrogen may be blown over the sample to help alleviate air bubbles trapped on the sieve.

4. After the composition sample has passed through the sieve, count the number of particles remaining on the sieve. (Take care to count the particles, as distinguished from air bubbles; additional air/nitrogen can be used if there is a question.) Record the number of encapsulates. Repeat counting three times.

5. Repeat steps 1-4 at less three more times, so that a total of at least four composition samples have been tested.

6. For each sample, divide the average number of particles counted by sample weight used to get particle number per gram of sample.

7. Average the particle numbers per gram of sample to provide the final particle number per gram composition value. A sample having an average of less than 2.5 particles per gram is rated as a "pass."

8. Clean the sieve(s) immediately after use.

EXAMPLES

Example 1

Preparation of an Encapsulate Slurry

An encapsulate slurry may be prepared according to the following procedure.

An oil solution, consisting of 150 g Fragrance Oil, 0.6 g DuPont Vazo-52, and 0.4 g DuPont Vazo-67, is added to a 35° C. temperature controlled steel jacketed reactor, with mixing at 1000 rpm (4 tip, 2" diameter, flat mill blade) and a nitrogen blanket applied at 100 cc/min. The oil solution is heated to 75° C. in 45 minutes, held at 75° C. for 45 minutes, and cooled to 60° C. in 75 minutes.

A second oil solution, consisting of 37.5 g Fragrance Oil, 0.5 g tertiarybutylaminoethyl methacrylate, 0.4 g 2-carboxyethyl acrylate, and 19.5 g Sartomer CN975 (hexafunctional aromatic urethane-acrylate oligomer) is added when the first oil solution reached 60° C. The combined oils are held at 60° C. for an additional 10 minutes.

Mixing is stopped and a water solution, consisting of 112 g 5% Celvol 540 polyvinyl alcohol, 200 g water, 1.1 g 20% NaOH, and 1.17 g DuPont Vazo-68WSP, is added to the bottom of the oil solution, using a funnel.

Mixing is again started, at 2500 rpm, for 60 minutes to emulsify the oil phase into the water solution. After milling is completed, mixing is continued with a 3" propeller at 350 rpm. The batch is held at 60° C. for 45 minutes, the temperature is increased to 75° C. in 30 minutes, held at 75° C. for 4 hours, heated to 90° C. in 30 minutes and held at 90° C. for 8 hours. The batch is then allowed to cool to room temperature.

The resulting encapsulates in the slurry have a volume weighted mean encapsulate size of about 5-20 microns. The encapsulates comprise about 10%, by weight of the encapsulates, of wall material, and about 90%, by weight of the encapsulates, of core material.

Example 2

Addition of Slurry to Base Detergent—OOA

The experiment below shows that adding an encapsulate slurry to a base detergent prior to adding a borate compound results in little to no visible aggregation. In sum, the order of addition ("OOA") is found to be significant.

In the following experiments, final detergent products are made by providing a base detergent and then adding components in different orders. For each step, the listed components were mixed together with an overhead mixer. See Table 2.

Key to components:

Base Det. Base detergent (present at about 76% of final product) according to the following formula:

| Base Detergent Ingredients | Parts by wt. |
|---|---|
| AES | 8.55 |
| HLAS | 1.52 |
| Amine Oxide | 0.53 |
| Citric acid | 1.66 |
| Fatty Acid | 0.53 |
| Monoethanolamine | 1.22 |
| DTPA (chelant) | 0.45 |
| Brightener | 0.05 |
| Ethoxylated PEI polymer | 0.30 |
| Water and misc. | 59.90 |

| | |
|---|---|
| Borate | Sodium Tetraborate (1.6% of final product) |
| Encap. | Perfume encapsulates, where the wall of the encapsulates includes an acrylate-based polymer and PVOH (encapsulates added as a slurry; encapsulates present as about 0.7 wt % of final product) |
| Struct. | Structurant premix containing hydrogenated castor oil (approx. 0.08% active in final product) |
| Adjuncts | Detergent adjuncts (formate, enzymes, perfume, antifoam, dye, carriers, etc.) |

TABLE 1

| Order of Addition (OOA) | | | | |
|---|---|---|---|---|
| OOA Step | Trial A (comp.) | Trial B (comp.) | Trial C | Trial D |
| 1 | Base Det. + Borate | Base Det. | Base Det. | Base Det. |
| 2 | Adjuncts | Borate | Adjuncts | Encap. |
| 3 | Encap. | Adjuncts + Struct. | Encap. + Struct. | Borate |
| 4 | Struct. | Encap. | Borate | Adjuncts + Struct. |
| Results | Visible aggregation | Visible aggregation | No visible aggregation | No visible aggregation |

Without wishing to be bound by theory, it is believed that in Trials A and B, the encapsulates are relatively concentrated when they are combined with borate, resulting in visible aggregation. It is further believed that in Trials C and D, the encapsulates have been sufficiently dispersed or diluted by the nil-borate base detergent (e.g., outside the hydrodynamic radius of the PVOH) so that when they come into contact with borate, no visible aggregation occurs. It can also be seen that in Trials C and D, adding structurant before or after the borate appears to have little visible difference in aggregation.

Example 3

Dilution of Slurry with Detergent Components

The experiment below shows that an encapsulate slurry may be diluted directly with carriers or actives that are otherwise found in a final detergent product.

An encapsulate slurry comprising approximately 45% encapsulates by weight of the slurry is provided. For some of the trials, the slurry is diluted to different levels with different diluents (e.g., detergent components), as shown below in Table 2.

The slurries (original or diluted) were then introduced to a base detergent so that the final detergent product contained approximately 0.7% encapsulates by weight of the final detergent product; the final detergents had a formula approximately the same as the final detergents in Example 2 above. In this example, the base detergents already contained borate when the diluted slurries were added.

When the original slurry (slurry no. 1) was added to the base detergent that comprised borate, white flocculates formed immediately in the final detergent product; this product was not aged.

The other final detergent products that incorporated diluted slurries (slurry nos. 2, 3, and 4) were aged under two different conditions: 1 week at room temperature, and approximately 7.5 weeks at 40° C. After aging, the final detergent products were analyzed for aggregation. The results are shown below.

TABLE 2

| Slurry No. | Encapsulate Level in Slurry by wt. of slurry (% of original slurry) | Diluent | Final detergent: Aged 1 week at room temperature | Final detergent: Aged 7.5 weeks at 40° C. |
|---|---|---|---|---|
| 1 (comp.) | 45% (100% of original) | None | N.A. (aggregation immediately visible; no aging) | N.A. |
| 2 (diluted) | 27% (60% of original) | Water and structurant[1] | No visible aggregation; some aggregation seen at 20x; passed Sieve Test | No visible aggregation; some aggregation seen at 20x; passed Sieve Test |
| 3 (diluted) | 13.5% (30% of original) | Water and structurant[1] | No visible aggregation; no significant aggregation at 20x; passed Sieve Test | No visible aggregation; no significant aggregation at 20x; passed Sieve Test |
| 4 (diluted) | 13.5 (30% of original) | Water, structurant[1], and nonionic surfactant[2] | No visible aggregation; no significant aggregation at 20x; passed Sieve Test | No visible aggregation; no significant aggregation at 20x; passed Sieve Test |

[1]Hydrogenated castor oil premix
[2]C12-14 ethoxylated alcohol; avg. 7 ethoxy groups (10% by weight of diluent)

As indicated in Table 2, the diluted slurries resulted in no visible aggregation in the final detergent products. Additionally, upon examination under a microscope (20×), only some aggregation was observed in the aged detergent product that comprised diluted slurry no. 2, and no significant aggregation was observed in the aged final detergent products that comprised diluted slurries 3 and 4. Additionally, each of the aged detergent products (comprising diluted slurries 2, 3, and 4, respectively) passed the Sieve Test described in the Test Methods section, showing fewer than 100 particles per gram composition.

Figure 6:
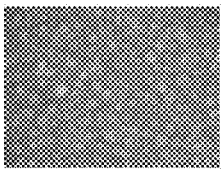
FIG. 6 shows 20× micrographs of the compositions described in Example 4.
Figure 6:
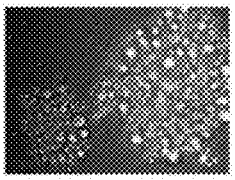
Figure 6:
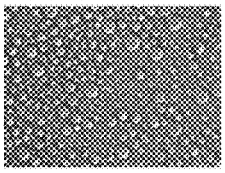
Figure 6:
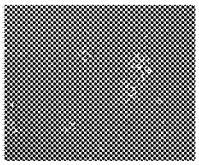
Figure 6:
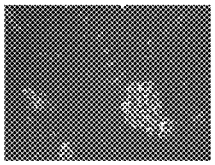
Figure 6:
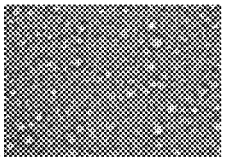
Figure 6:
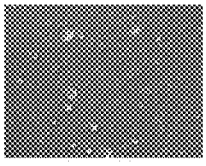
Figure 6:
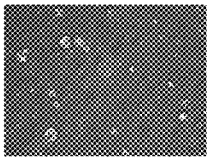
Figure 6:
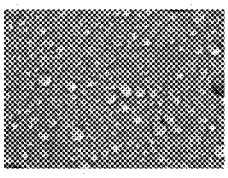
Figure 6:
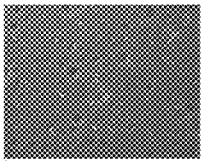
Figure 6:
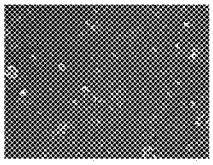

FIG. 6 includes a table that includes micrographs of slurries 1-4, as well as micrographs of the resulting final detergent products.

Example 4

Heavy Duty Liquid (HDL) Detergent Formulations

Exemplary, non-limiting formulations of heavy duty liquid (HDL) detergent formulations according to the present disclosure are provided below in Table 3.

TABLE 3

| Ingredient | HDL 1 | HDL 2 | HDL3 | HDL4 | HDL 5 | HDL 6 |
|---|---|---|---|---|---|---|
| Alkyl Ether Sulphate | 0.00 | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| Ethoxylated Alcohol | 8.0 | 6.0 | 5.0 | 7.0 | 5.0 | 3.0 |
| Citric Acid | 5.0 | 3.0 | 3.0 | 5.0 | 2.0 | 3.0 |
| Fatty Acid | 3.0 | 5.0 | 5.0 | 3.0 | 6.0 | 5.0 |
| Ethoxysulfated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes | 1.20 | 0.80 | 0 | 1.2 | 0 | 0.8 |
| Brightener (disulphonated diamino stilbene based FWA) | 0.14 | 0.09 | 0 | 0.14 | 0.01 | 0.09 |
| Cationic hydroxyethyl cellulose | 0 | 0 | 0.10 | 0 | 0.200 | 0.30 |
| Poly(acrylamide-co-diallyldimethylammonium chloride) | 0 | 0 | 0 | 0.50 | 0.10 | 0 |
| Hydrogenated Castor Oil Structurant | 0.50 | 0.44 | 0.2 | 0.2 | 0.3 | 0.3 |
| Boric acid | 2.4 | 1.5 | 1.0 | 2.4 | 1.0 | 1.5 |
| Ethanol | 0.50 | 1.0 | 2.0 | 2.0 | 1.0 | 1.0 |
| 1,2 propanediol | 2.0 | 3.0 | 1.0 | 1.0 | 0.01 | 0.01 |
| Glutaraldehyde | 0 | 0 | 19 ppm | 0 | 13 ppm | 0 |
| Diethyleneglycol (DEG) | 1.6 | 0 | 0 | 0 | 0 | 0 |
| 2,3-Methyl-1,3-propanediol (M pdiol) | 1.0 | 1.0 | 0 | 0 | 0 | 0 |
| Mono Ethanol Amine | 1.0 | 0.5 | 0 | 0 | 0 | 0 |
| NaOH Sufficient To | pH 8 | pH 8 | pH 8 | pH 8 | pH 8 | pH 8 |

TABLE 3-continued

| Ingredient | HDL 1 | HDL 2 | HDL3 | HDL4 | HDL 5 | HDL 6 |
|---|---|---|---|---|---|---|
| Provide Formulation pH of: | | | | | | |
| Sodium Cumene Sulphonate (NaCS) | 2.00 | 0 | 0 | 0 | 0 | 0 |
| Silicone (PDMS) emulsion | 0.003 | 0.003 | 0.003 | 0.003 | 0.003 | 0.003 |
| Perfume | 0.7 | 0.5 | 0.8 | 0.8 | 0.6 | 0.6 |
| Polyethyleneimine | 0.01 | 0.10 | 0.00 | 0.10 | 0.20 | 0.05 |
| Perfume Encapsulates* | 1.00 | 5.00 | 1.00 | 2.00 | 0.10 | 0.80 |
| Water | Balance to 100% | Balance to 100% | Balance to 100% | Balance to 100% | Balance to 100% | Balance to 100% |

*Encapsulates are provided as 20-60% active slurry (aqueous solution) and then diluted in accordance with the present disclosure. Core/wall ratio can range from 80/20 up to 90/10 and average encapsulate diameter can range from 5 μm to 50 μm. The encapsulate walls include an acrylate polymer and PVOH.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a detergent composition, comprising the steps of:

a. providing a slurry comprising from about 20 wt % to about 60 wt % of encapsulates and diluting the slurry with a diluent comprising water and an external structurant to form a first composition comprising encapsulates, wherein the first composition comprises no more than about 15 wt % of the encapsulates, wherein the encapsulates comprise polyvinyl alcohol polymer; and wherein the encapsulates are microcapsules that comprise a core and a shell at least partially surrounding the core, wherein the core comprises a benefit agent, and wherein the shell comprises at least a portion of the polyvinyl alcohol polymer;

b. combining the first composition with a second composition comprising a borate compound, thereby forming a product composition.

2. A method according to claim 1, wherein the benefit agent of the core comprises perfume raw materials.

3. A method according to claim 1, wherein the core further comprises a partitioning modifier.

4. A method according to claim 1, wherein the shell comprises a shell material selected from the group consisting of polyethylenes; polyamides; polystyrenes; polyisoprenes; polycarbonates; polyesters; polyacrylates; acrylics; aminoplasts; polyolefins; polysaccharides; gelatin; shellac; epoxy resins; vinyl polymers; water insoluble inorganics; silicone; and mixtures thereof.

5. A method according to claim 1, wherein the shell comprises a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

6. A method according to claim 5, wherein the shell material comprises a polyacrylate.

7. A method according to claim 1, wherein the encapsulates have a volume weighted mean encapsulate size of from about 0.5 microns to about 100 microns.

8. A method according to claim 1, wherein the borate compound is selected from the group consisting of boric acid, boric acid derivatives, and combinations thereof.

9. A method according to claim 1, wherein the borate compound is present in the product composition at a level of about 0.1 wt % to about 4 wt %.

10. A method according to claim 1, wherein the diluent further comprises organic solvent, surfactant, or combinations thereof.

11. A method according to claim 1, wherein the product composition comprises from about 0.1 wt % to about 5 wt % of the encapsulates.

12. A method according to claim 1, wherein the product composition further comprises an enzyme.

13. A method according to claim 1, wherein the product composition further comprises an external structurant.

14. A method according to claim 1, wherein the product composition comprises from about 5 wt % to about 60 wt % of a surfactant system.

15. A method according to claim 1, wherein either the first composition or the second composition is a base detergent comprising from about 5 wt % to about 60 wt % of a surfactant system.

* * * * *